United States Patent [19]

Campbell et al.

[11] 4,393,788

[45] Jul. 19, 1983

[54] RETRACTABLE PROTECTIVE-SCREENS AND EQUIPMENT INCLUDING THEM

[76] Inventors: Bernard F. Campbell, 95 Havelock Rd.; Leslie Vallance, 6 Hollingbury Copse, both of Brighton, East Sussex, England

[21] Appl. No.: 230,152

[22] Filed: Jan. 30, 1981

[51] Int. Cl.[3] ..... E04N 9/00

[52] U.S. Cl. ..... 109/2

[58] Field of Search ..... 109/2, 3; 49/40, 41

[56] References Cited

U.S. PATENT DOCUMENTS

| | | | |
|---|---|---|---|
| 3,045,615 | 7/1962 | Atchison | 49/40 |
| 3,046,914 | 7/1962 | Sandberg | 109/17 |
| 3,128,508 | 4/1964 | Burnham | 49/40 |
| 4,157,071 | 6/1979 | King | 109/11 |

FOREIGN PATENT DOCUMENTS

| | | | |
|---|---|---|---|
| 606734 | 11/1978 | Switzerland | 109/17 |

*Primary Examiner*—Gene Mancene
*Assistant Examiner*—Wenceslao J. Contreras
*Attorney, Agent, or Firm*—Pollock, VandeSande and Priddy

[57] ABSTRACT

The protective screen of a through-the-wall automated-teller machine covers a recessed part of the machine facia and is retracted through a slot in the facia wall to reveal environmentally-vulnerable items for customer operation. The screen, which is in the form of a curved metal plate, is driven in both retraction and extension via a single rack-and-pinion coupling. The rack is a length of powered-drive belting clamped upon a foam-rubber backing to the inside of the plate centrally of two pairs of arcuate channel-guides for the two side-edges respectively of the plate. The channel-guides of one pair are mounted on opposed side-walls of the facia recessed-part externally of the machine whereas those of the other pair are mounted internally behind the facia. Nylon blocks clipped to corners of the plate run in the channel-guides.

13 Claims, 5 Drawing Figures

RETRACTABLE PROTECTIVE-SCREENS AND EQUIPMENT INCLUDING THEM

This invention relates to retractable protective-screens and equipment including them.

The invention is especially, though not exclusively, concerned with the provision of retractable protective-screens in cash-dispensing or other automated-teller machines. Where the services of such machines are to be available to customers outside normal banking or business hours they are conveniently installed through an external wall of a bank or other building to be accessible from the street or other open environment. More particularly, a facia of the machine, incorporating at least a keyboard for operation by the customer to communicate with the machine, and some form of display device for conveying instructions and other messages to the customer from the machine, will be mounted in the external wall. In such circumstances it is sometimes necessary, or regarded as desirable, to afford parts of the facia protection against weather conditions (especially extremes of heat and cold) and vandalism. It is to this end that retractable protective-screens have been utilized in cash-dispensing and other automated-teller machines, such screen covering the keyboard and display device, and any other item to be protected, on the machine facia until such time as a customer requests use of the machine, whereupon the screen is retracted to reveal the protected items for use by the customer in furthering the transaction to be made. When the transaction is complete the screen is extended once again to afford protection against the environment until the next customer-request for use of the machine is made.

The retractable protective-screen used in a cash-dispenser or other automated-teller machine conventionally takes the form of a curved metal plate that is driven from within the machine in both extension and retraction. The provision of drive to such a curved plate, especially insofar as meeting the need for it to move smoothly through the facia, has proved troublesome. Also it has been the practice to drive the plate via couplings established along both of its side-edges, and this has proved expensive in that it requires the provision of special and costly components for its implementation and does not readily allow for overall commonality of such components as between one model of machine and another. Furthermore, the motor-torque required to drive the plate has been found to be undesirably high.

It is one of the objects of the present invention to provide a form of retractable protective-screen that can be utilized to overcome at least in part, some or all of the above disadvantages of existing screens.

According to the present invention there is provided a retractable protective-screen in the form of a member having two side-edges that are guided for movements of the member in extension and retraction of the screen, wherein drive means for driving said member in at least one of said movements is coupled to said member to establish driving engagement therewith at a location on said member spaced inwardly from both of said side-edges.

The coupling is preferably made centrally of the plate or other member and is preferably established between a drive pinion and a rack carried by the screen-member. In the latter case the rack may comprise a length of powered-drive belting, and such belting may advantageously be clamped to the screen-member with resilient material sandwiched between it and the screen-member.

The screen is preferably driven by the said drive means in both extension and retraction, but depending upon the particular application of the screen, it is possible to arrange for it to be driven in only one of these movements, the other movement being executed, for example, manually.

The present invention is applicable to the provision of protection against attack and for other environmental purposes in the context of cash-dispensing and other automated-teller machines, but also in a wider context. More especially the present invention may be utilized in the provision of a retractable protective-screen for a depository of the kind used by banks and other institutions for the reception of cash and other valuables for safe-keeping.

According to a feature of the present invention there is provided a customer-operable automated-teller machine which includes a facia having an environmentally-vulnerable part that is required to be exposed during customer-operation of the machine, and a protective screen-member that is guided at its side-edges for movements through the facia between a retracted position in which said part is exposed as aforesaid and an extended position in which said part is covered by the protective screen-member, and means operable selectively to drive the screen-member in at least one direction between its retracted and extended positions, wherein said drive means comprises a rack carried by said screen-member inwardly from said side-edges, a pinion drivingly engaging said rack, and means operable selectively to rotate said pinion to drive said screen-member via said rack in said one direction.

An automated-teller machine incorporating a retractable protective-screen in accordance with the present invention will now be described, by way of example, with reference to the accompanying drawings in which.

The automated-teller machine to be described is operable to dispense cash and to perform other banking functions for bank customers after, as well as during, normal banking hours. Each customer authorized to use the machine is issued with an individual rectangular plastics card that carries data relating to the customer's account recorded in one or more magnetic-recording tracks on the card, and is informed of a secret, personal-identification number for use with the card. When the customer wishes to use the machine he inserts the card in a card-reception slot that is located to one side of the exposed facia of the machine.

Figure 1:
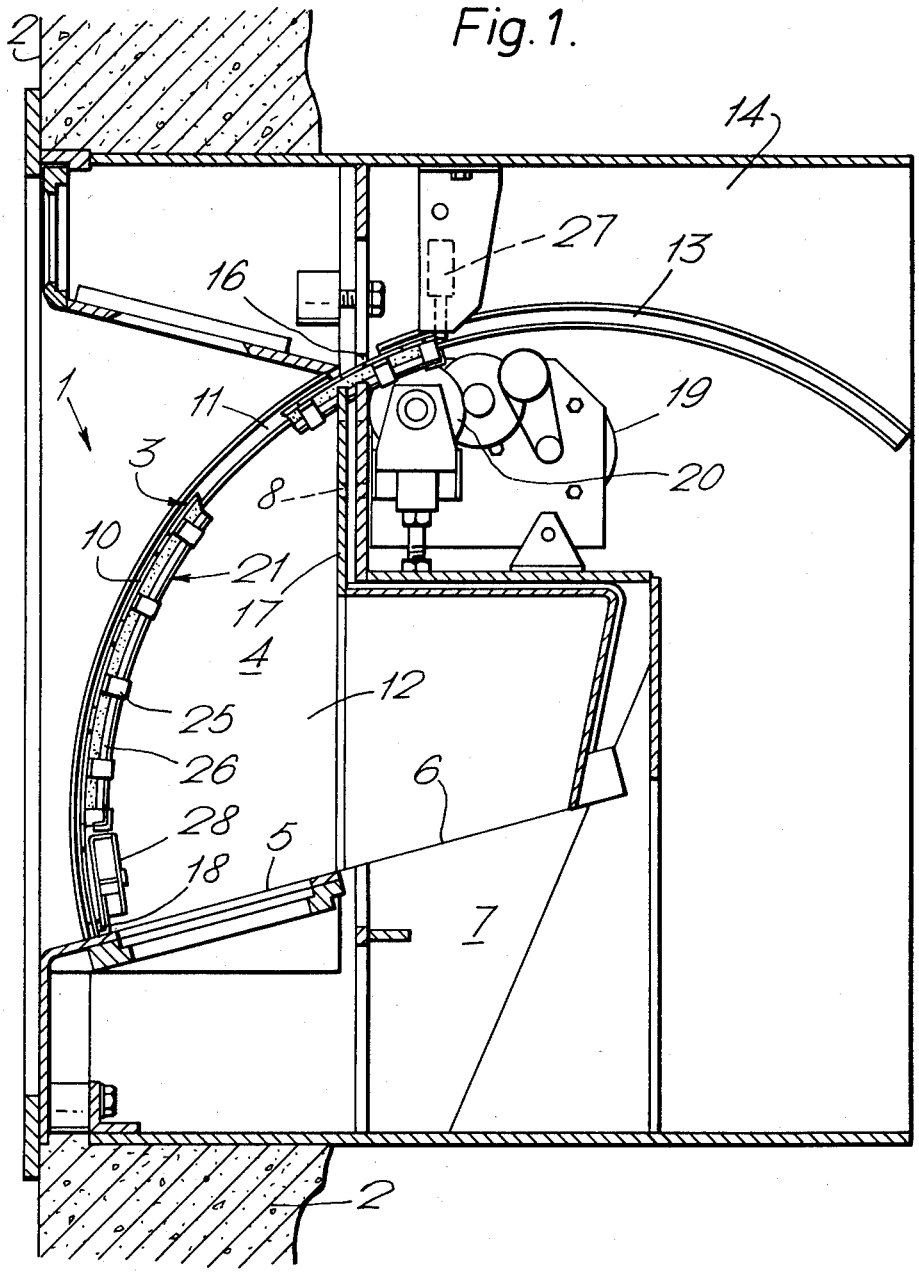
FIG. 1 is a sectional side-elevation of the externally-exposed facia and cooperating internal security-sleeve of the automated-teller machine, showing the retractable protective-screen partly broken-away.
Figure 2:
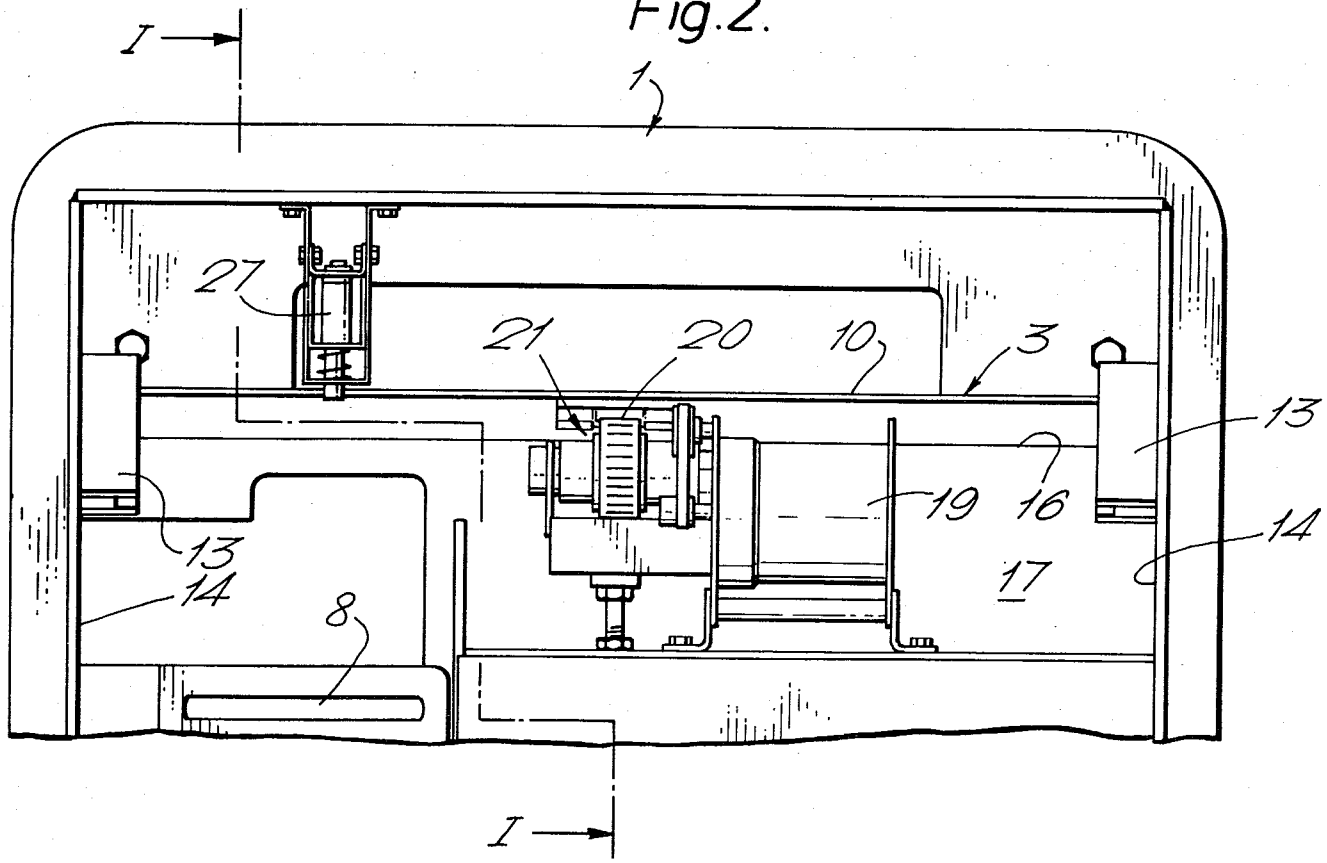
FIG. 2 is a view of part of the facia from the rear within the security sleeve of the automated-teller machine, the section of FIG. 1 being taken on the line I—I of FIG. 2.
Figure 3:
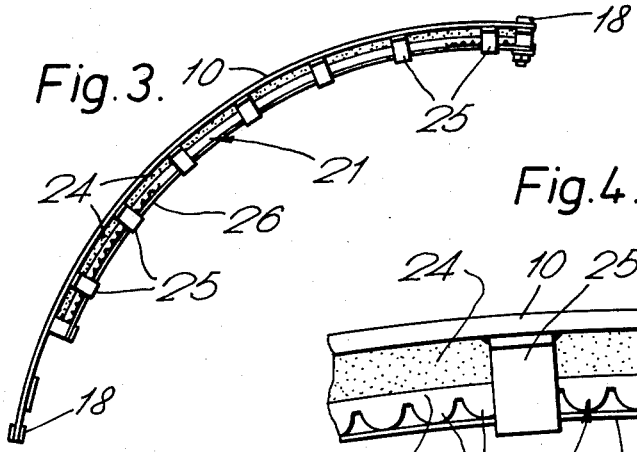
FIG. 3 is a side elevation of the retractable protective screen.
Figure 4:
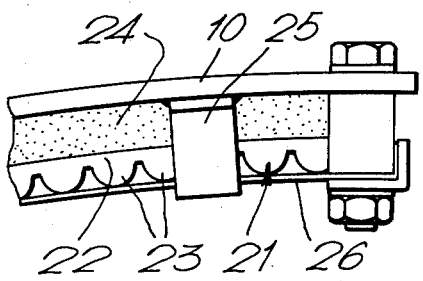
FIG. 4 shows the upper-end portion of the retractable protective-screen of FIG. 3 to an enlarged scale.
Figure 5:
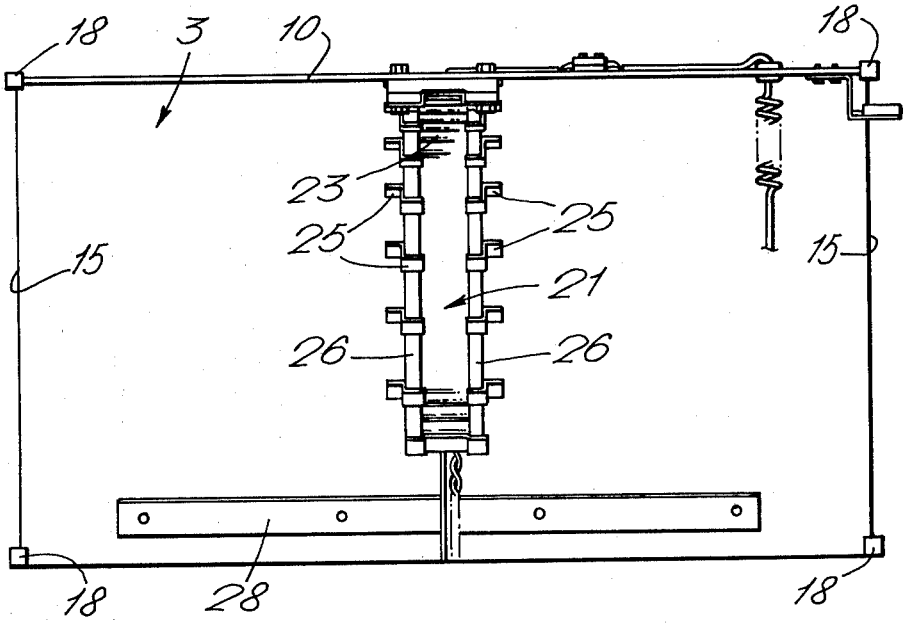
FIG. 5 is a view from the inside of the retractable protective-screen.

Referring to FIG. 1, the facia 1 of the automated-teller machine is mounted in an external wall 2 of the bank building to be accessible from outside at all times, and incorporates a protective screen 3 that covers a recessed part 4 of the facia 1 to protect that part from the weather and general environment external of the bank, as well as from vandalism. The machine responds to insertion of the customer's card through the card-reception slot (not shown), provided it is inserted with the correct orientation and satisfies a primary test as to its authenticity, by retracting the screen 3. Retraction of the screen 3 reveals a keyboard 5, the screen 6 of a visual-display unit 7, and a cash-dispensing slot 8, all mounted within the recessed part 4 of the facia 1. The customer is next instructed by messages displayed on the screen 6 of the visual-display unit 7 to operate the keys of the keyboard 5 to enter his personal identification number into the machine. The machine checks that appropriate correspondence exists between the entered number and magnetically-recorded data read from the inserted card, and then proceeds by messages on the display-screen 6 to issue to the customer step-by-step instructions and requests for further operation of the keyboard 5 in accordance with the banking function to be performed.

If the requested function involves the dispensing of cash to the customer, this is carried out by a cash dispensing unit (not shown) of the machine which is located behind the recessed part 4 of the facia 1 and which delivers banknotes in accordance with the request, through the cash-dispensing slot 8. The dispensing of cash takes place after the customer's card has been returned through, and removed by the customer from, the card-entry slot. Once the delivered banknotes have been removed by the customer from the cash-dispensing slot 8, or the requested banking function has otherwise been completed, the screen 3 is extended to cover once again the keyboard 5, the display-screen 6 and the dispensing slot 8 in the recessed part 4 of the facia 1, for their protection.

Referring now also to FIGS. 2 to 5, the protective screen 3 is in the form of a curved steel plate 10 that runs in two pairs of arcuate guides. The guides of one pair are formed by curved channel-pieces 11 that are mounted on the opposed side-walls 12 of the recessed part 4 of the facia 1, whereas the guides of the other pair are formed by similarly-curved channel-pieces 13 that are welded to the opposite side walls 14 of a steel sleeve that extends backwardly from the recessed part 4 of the facia 1 and provides a protective enclosure for the reserves of banknotes from which dispensing is made through the slot 8. The plate 10 with its side-edges 15 guided for movements of the screen in extension and retraction by the channel-pieces 11 and 13, extends through a slot 16 in the back-wall 17 of the facia 1. The side-edges 15 of the plate 10 are engaged with the respective channel-pieces 11 at the two front corners of the screen 3, and with the respective channel-pieces 13 at the other two, rear corners. More particularly, nylon blocks 18 are clipped to the side-edges 15 at the four corners of the plate 10 and run in the respective channel-pieces throughout extension and retraction of the screen 3 within the recessed part 4.

The plate 10 is driven through the slot 16 in extending and retracting the screen 3, by an electric motor 19 that is mounted immediately behind the back-wall 17 of the facia 1. Drive from the motor 19 is applied to the screen 3 via a pinion 20 that engages with a rack 21 on the plate 10. The rack 21 is mounted centrally of the inside face of the plate 10, and extends on this face throughout the whole of the curved length of the plate 10 apart from a small leading portion that remains projecting through the slot 16 when the screen 3 is fully retracted.

The rack 21 is provided by a length of nylon-reinforced rubber belting 22 cut from a powered-drive belt, so having integrally-formed rounded teeth 23 for engagement by the pinion 20; the pinion 20 is in this respect of the kind used in powered-drive belt systems. The belting 22 is clamped to the plate 10 against a foam-rubber backing 24, being held in place by metal clips 25 that are welded to the plate 10 at intervals along both sides of the rack 21. Two metal strips 26 that extend the length of the belting 22 are wedged beneath the clips 25 on the two sides to apply clamping pressure along the length of the belting 22 and retain it firmly in place against its foam backing 24. The foam backing 24 provides the rack 21 with a measure of resilience in compression that allows for larger tolerances of manufacture of the screen 3, and provides for quieter operation in extension and retraction.

Manufacture of the screen 3 is simplified by the provision of central drive to the plate 10, and also by the use of readily-available belting for provision of the arcuate rack 21; the specific construction described also allows for easy replacement of the rack during maintenance. The use of central drive avoids the complications experienced with earlier proposals for drive to be applied along both side-edges, and also enables a standard mechanism to be used as between screens of different widths required for different models of machine; the torque required of the motor 19 is also less than with the earlier proposals, and this enables a cheaper and more-readily available electric motor to be used. Reduction in the torque requirement also arises from the use of the four-corner mounting of the plate 10 in the side-guides. More especially, smoother movement of the screen 3 and less frictional loading is experienced by confining the engagement of the plate 10 with the channel-pieces 11 and 13 to the blocks 18 at the corners. With this corner-mounting it is not necessary for the guides on either side of the screen 3 to be continuous from the side-walls 12 of the facia 1 through the back-wall 17 onto the side-walls 14 of the security sleeve; the two blocks 18 to the front of the screen 3 are confined to their own channel-pieces 11 on the walls 12, whereas the two blocks 18 to the rear are confined to their own channel-pieces 13 on the walls 14, throughout the full range of movement of the plate 10 in extension and retraction of the screen 3. This significantly eases the tolerances required of manufacture and intercoupling between facia and security sleeve.

The torque required of the motor-drive for screen-retraction can be equalized with that for extension by use of a spring (not-shown) for counter-balancing the plate 10. Such a spring is in this context coupled to the plate 10 to be in tension when the screen 3 is closed so as to assist the motor 19 in retraction.

A solenoid-operated latch 27 mounted behind the back-wall 17 of the recessed part 4 of the facia 1 engages with the upper, rear-edge of the plate 10 when the screen is extended. The latch 27 blocks retraction of the screen 3 until an electrical signal to withdraw it is received from a control unit (not shown) of the machine. The motor 19 is energized at the same time from the control unit to drive the plate 10 and retract the screen 3. Microswitches (not shown) respond to full retraction of the screen to signal this condition to the control unit and interrupt energization of the motor 19. The motor 19 is again powered from the control unit so as to drive the plate 10 in the opposite sense and extend the screen 3, until other microswitches (not shown) signal that it is fully extended. Provision is made to halt extension of the screen 3 in the event that this is obstructed. In this respect a fingerbar (not shown) is mounted on a bracket 28 on the inside face of the plate 10 near the lower, front-edge, and deflection of the bar caused by an obstruction, is signalled to the control unit to bring about the required interruption of power supply to the motor 19.

Electrical heaters (not shown) are incorporated in the channel-pieces 11 to ensure freedom of the plate 10 for movement in spite of exposure of the machine facia 1 to low-temperature conditions.

Although the retractable protective-screen of the present invention has been referred to and described above in the context of cash-dispensing and automated-teller machines, the present invention is not limited in its application to this specific context. The screen may also be pulled, for example, to depositories such as provided in the outside wall of a bank to receive cash and other valuables for safe-keeping overnight; in this context the screen covers the entrance-way to a safe or vault for protection, and is retracted to reveal the deposit-receiving mechanism of the entrance-way only while a deposit is being made.

We claim:

1. In equipment including a retractable protective-screen in the form of a member having two side-edges that are guided for movements of the member in extension and retraction of the screen, and drive means coupled to said member to drive it in at least one of said movements, the improvement wherein said drive means is coupled to said member to established driving engagement therewith via a rack-and-pinion coupling, said coupling comprising a rack carried by said member, said rack being an elongate strip of flexible material having projecting teeth formed integrally therewith, said strip being secured to said member at least at spaced positions along the length of the strip to extend on said member substantially centrally thereof intermediate said side-edges, and a pinion engaging with the teeth of the rack, said drive means being coupled to said pinion to rotate the pinion and thereby drive said member via said rack.

2. Equipment according to claim 1 wherein said strip comprises a length of powered-drive belting.

3. Equipment according to claim 1 including resilient material, said strip being clamped to said member with said resilient material sandwiched between said strip and said member.

4. Equipment according to claim 1 including channel-pieces for guiding the screen in extension and retraction, and elements located on said side-edges adjacent corners of the said member to run in said channel-pieces so as thereby to guide the screen as aforesaid.

5. Equipment according to claim 1 wherein said member is a curved metal plate, said strip being clamped along its length to said plate to conform to the curve of the plate.

6. In equipment including a protective screen inn the form of a substantially rectangular plate that extends through a slot in a wall of the equipment, guide means for guiding opposed side-edges of the plate throughout movements of the plate through said slot between an extended position in which the plate is extended with respect to the front of the wall and a retracted position in which the plate is retracted with respect to said front of the wall, and means coupled to the plate to drive the plate between said extended and retracted positions, the improvement wherein said drive means is coupled to the plate via a rack-and-pinion coupling, the rack of said coupling being an elongate strip of flexible material having projecting teeth formed integrally therewith and said strip being secured to said plate to extend substantially parallel to said side-edges and substantially centrally of the plate intermediate said side-edges, and the pinion of said coupling being drivingly engaged with the teeth of the rack, said drive means including means operable to rotate the pinion in selectively one or the other of two senses for respectively retracting or extending the plate through said wall.

7. In equipment including a protective screen in the form of a substantially rectangular plate that extends through a slot in a wall of the equipment, guide means for guiding opposed side-edges of the plate throughout movements of the plate through said slot between an extended position in which the plate is extended with respect to the front of the wall and a retracted position in which the plate is retracted with respect to said front of the wall, and means to drive the plate between said extended and retracted positions, the improvement wherein said drive means comprises a rack-and-pinion coupling to the plate, the rack of said coupling being carried by said plate to extend substantially parallel to said side-edges of the plate, and the pinion of said coupling being drivingly engaged with said rack, and means operable to rotate said pinion in selectively one or the other of two senses for respectively retracting or extending the plate through said wall, said guide means comprising two pairs of guides, one pair of guides being located entirely to the front of said wall and the other pair of guides being located entirely to the rear of said wall, and four elements located on said side-edges of said rectangular plate to run in respective ones of said guides for guiding the plate throughout movements in retraction and extension.

8. Equipment according to claim 7 wherein said plate is curved and said guides are each of arcuate configuration to guide the curved plate in said movements.

9. Equipment according to claim 7 wherein said rack comprises a length of powered-drive belting.

10. Equipment according to claim 7 including resilient material, and wherein said rack is clamped to the plate with said resilient material as a backing to said rack.

11. Equipment according to claim 7 wherein said rack is mounted to extend substantially centrally of said plate.

12. In a customer-operable automated-teller machine which includes a facia having an environmentally-vulnerable part that is required to be exposed during customer-operation of the machine, and a protective screen-member that it guided at its side-edges for movements through the facia between a retracted position in which said part is exposed as aforesaid and an extended position in which said part is covered by the protective screen-member, and means operable selectively to drive the screen-member in at least one direction between its retracted and extended positions, the improvement wherein said drive means is coupled to said screen-member via a rack-and-pinion coupling, the rack of said coupling being an elongate strip of flexible material having projecting teeth formed integrally therewith and said strip being secured along its length to said screen-member to extend on said member substantially centrally thereof intermediate said side-edges, the pinion of said coupling drivingly engaging with said teeth of said rack, and said drive means comprising means operable selectively to rotate said pinion to drive said screen-member via said rack in said one direction.

13. A machine according to claim 11, wherein said rack is a length of resilient powered-drive belting.

* * * * *